United States Patent [19]

Coppock et al.

[11] 3,939,083

[45] *Feb. 17, 1976

[54] TEXTILE-MACHINERY LUBRICANT COMPOSITION

[75] Inventors: Walter J. Coppock, Wallingford; James R. Amaroso, Newtown Square, both of Pa.; John Q. Griffith, III, Claymont, Del.

[73] Assignee: Sun Oil Company of Pennsylvania, Philadelphia, Pa.

[ * ] Notice: The portion of the term of this patent subsequent to May 28, 1991, has been disclaimed.

[22] Filed: Feb. 7, 1974

[21] Appl. No.: 440,615

Related U.S. Application Data

[63] Continuation-in-part of Ser. No. 240,806, April 4, 1972, Pat. No. 3,813,339.

[52] U.S. Cl. ..... 252/42; 252/35; 252/36; 252/41; 252/49.6

[51] Int. Cl.[2] ..... C10M 1/24

[58] Field of Search ..... 252/59, 49.6, 72, 8.6, 252/35, 36, 41, 42; 208/18

[56] References Cited

UNITED STATES PATENTS 3,813,338 5/1974 Coppock et al. ..... 252/42.1

*Primary Examiner*—Delbert E. Gantz
*Assistant Examiner*—Andrew H. Metz
*Attorney, Agent, or Firm*—George L. Church; Donald R. Johnson; J. Edward Hess

[57] ABSTRACT

An improved high retention lubricant for textile-machinery comprises a naphthenic base oil, a tackiness agent (e.g., polyisobutylene), and an effective amount of a lithium soap (e.g., 0.1 to 1.5% lithium stearate) to provide a MacMichael viscosity at 70°F of at least 5, more preferred at least 15 (preferably 20 to 35). Typically, the base oil can have a viscosity in the range of 60 to 600 SUS at 100°F (more preferably 125 to 300 SUS) and an aniline point in the range of 150 to 170°F, said base oil comprising at least one hydrorefined naphthenic oil component having a viscosity in the range of 40 to 12,000 SUS at 100°F, and preferably, is a wide boiling range blend containing at least two such hydrorefined naphthenic oils.

10 Claims, No Drawings

TEXTILE-MACHINERY LUBRICANT COMPOSITION

Cross Reference to Related Application

This application is a continuation-in-part of application Ser. No. 240,806, now U.S. Pat. No. 3,813,339. Said application 240,806 is related to copending applications Ser. No. 35,231, filed May 6, 1970 (now abandoned); Ser. No. 60,642, filed Aug. 3, 1970 (now abandoned); Ser. No. 178,193, filed Sept. 7, 1971 and Ser. No. 178,479, filed Sept. 7, 1971 (now U.S. Pat. No. 3,816,316.

BACKGROUND OF THE INVENTION

A textile-machine lubricant must perform satisfactorily in textile-mill service where adequate lubricating properties must be combined with high retention (e.g., the ability to stay put in a bearing). Stray oil thrown from a bearing can find its way to the cloth being manufactured and complicate the cleaning steps taken at the end of the process.

Prior art textile-machinery lubricants have been compounded with high viscosity index oils (e.g., solvent-refined paraffinic lube oil) and a combination of additives to give the necessary retention properties. One of these materials, a lithium soap, was finely dispersed in the paraffinic oil, but was not in complete solution. Under field conditions, the soap separated from the product. This problem of gel stability has been frequently mentioned in the prior art.

The present invention relates to an improved high retention lubricant for textile-machinery which does not separate under field conditions, and which is equivalent or superior to prior art textile-machinery which does not separate under field conditions, and which is equivalent or superior to prior art textile lubricants in such performance characteristics as lubricating, retention and cloth scourability and which does not discolor or degrade textile fibers.

This improved high retention lubricant is not only resistant to separation but also has brighter appearance, produces less staining if it comes into contact with fabric, and provides rubber seal protection and conditioning. Furthermore, in mill trials this new lubricant provided lower mill consumption of electrical power required by such textile-machinery as Draper Shuttleless Looms.

Among the relevant publications of record in one or more parent applications are the following:

| U.S. Pat. No. | Issue Date | Patentee | Class/Sub |
|---|---|---|---|
| 1,789,331 | 1/31 | Becker | 252/41 |
| 2,074,089 | 3/37 | Zimmer et al. | 252/41 |
| 2,121,796 | 6/38 | Mikeska et al. | 252/49.8X |
| 2,298,660 | 10/42 | Stevens et al. | 252/52RX |
| 2,322,209 | 6/43 | Brutton | 252/42.1X |
| 2,390,450 | 12/45 | Morgan | 252/36 |
| 2,406,655 | 8/46 | Bax et al. | 252/36 |
| 2,416,503 | 2/47 | Trautman et al. | 252/49.6 |
| 2,651,616 | 9/53 | Bryant et al. | 252/41 |
| 2,697,693 | 12/54 | Browning et al. | 252/41 |
| 2,760,936 | 8/56 | Baker | 252/41 |
| 2,769,781 | 11/56 | Butcosk | 252/40 |
| 2,844,537 | 7/58 | McCarthy et al. | 252/41 |
| 2,846,394 | 8/58 | Brunstrum et al. | 252/41 |
| 3,431,863 | 12/69 | Donaldson et al. | 208/217X |
| 3,383,312 | 5/68 | Coppock | 252/36 |
| 2,595,789 | 7/71 | Coshburn | 252/36X |
| 3,694,363 | 9/72 | Griffith et al. | 252/41X |

It should be noted that much of the above noted art is concerned with greases (which generally use high viscosity base oils and large amounts of soap), whereas the textile machinery lubricant of the present invention is a "thickened oil" and, in use, is more like an oil than a grease.

SUMMARY OF THE INVENTION

An improved high retention lubricant for textile-machinery comprises a naphthenic base oil, a tackiness agent (e.g., polyisobutylene, isotactic polypropylene, polyacrylates, etc.), and an effective amount of a lithium soap (e.g., 0.1 to 1.5% lithium stearate) to provide a MacMichael viscosity at 70°F of at least 5, more preferred at least 20 to 35). The base oil can have a viscosity in the range of 60 to 600 SUS at 100°F (more preferably 125 to 300 SUS) and an aniline point in the range of 150° to 170°F, said base oil comprising at least one hydrorefined naphthenic oil component having a viscosity in the range of 40 to 12,000 SUS at 100°F, and preferably, is a wide boiling range blend containing at least two such hydrorefined naphthenic oils. For example, the lubricant can comprise 75 parts by weight of 100 SUS hydrorefined naphthenic oil, 20 parts of 2400 SUS hydrorefined naphthenic oil, 2 parts of a high molecular weight (apparent molecular weight in oil of about 100,000) polyisobutylene tackiness agent, 1 part of lithium stearate, 1.5 parts of chlorinated paraffin as an antiwear agent, and 5 ppm of silicone antifoam.

The improved high retention lubricant for textile-machinery of the present invention comprises additives and a base oil having an SUS viscosity in the range of 60 to 600 at 100°F (more preferably 125° to 300°F), consisting essentially of one or more hydrorefined naphthenic oils of the lubricating oil viscosity range (e.g., 45 to 12,000 SUS at 100°F) and having an aniline point in the range of 140° to 190°F, more preferred 150° to 170°F, a viscosity-gravity constant (VGC) in the range of 0.820 to 0.899, more preferred 0.840 to 0.899, and an ultraviolet absorptivity (i.e., UVA) at 260 millimicrons, (i.e., 260 UVA) which is at least 40% less than that of an unhydrorefined naphthenic lube of the same viscosity (VGC) and boiling range. Preferably, the UVA of the base oil at 335 millimicrons (i.e., 335 UVA) is in the range of 0.0 to 0.4 (typically 0.02 to 0.2) and the ASTM D-1500 initial color is less than 4.0 (more preferably no greater than 2.5).

The additives comprise a tackiness agent and a lithium soap in sufficient quantity to thicken the base oil and provide a minimum MacMichael viscosity, at 70°F, of 5 (more preferably, at least 15, typically in the range of 20 to 35, e.g., about 25). The preferred tackiness agents are olefin polymers (e.g., atactic polypropylene, or polyisobutylene rubber) and can partially or fully hydrogenated; however, any oil-compatable tackiness agent (e.g., polyacrylates, aluminum oleate, or natural rubber obtained from dehydrated latex) can be used. The preferred range for the polyisobutylene polymers as commercially available, as indilution with oil (about 50%) is 0.3 to 6%, more preferably 1 to 3%. In any event, the amount used must be sufficient to cause the lubricant to be highly retentive on a bearing; however, the amount must be less than that which will cause the lubricant to be "stringy".

Another preferred additive is an antiwear agent which will not harm textiles, most preferred is 0.3 to 10% of a chlorinated paraffin; however, 0.2 to 2% of tricresyl phosphate or a combination of these two additives can also be used. Optionally, the improved high retention lubricant for textile machinery can also contain an antifoam (such as 0.5 to 20 ppm of "active" silicone antifoam). Generally such an antifoam is used as a dilute solution or suspension containing about 1% of the active ingredient.

To further safeguard against discoloration, an antioxidant such as 0.05 to 1% ditertiarybutyl paracresol (i.e., DBPC) can also be included.

In general, any additive used in the textile-machine lubricant of the present invention should have an acid number less than 25 and the total, compounded lubricant should have an acid number less than 0.5 and a "neutral" pH (preferably, 6.2 to 7.7, more preferred 6.8 to 7.2).

FURTHER DESCRIPTION

The base oil can consist essentially of a narrow-boiling range, hydrorefined naphthenic lube of the desired SUS viscosity or the desired viscosity base oil can be obtained from a wider boiling range blend of two or more narrow-boiling range naphthenic oils (e.g., a 150 SUS base oil can be obtained directly by hydrogenation of a 160 SUS distillate or can be obtained by hydrogenating a blend of 100 and 2,500 SUS distillate or, more preferred, the 150 SUS base oil can be obtained by blending a 100 SUS hydrorefined distillate with a 2,500 SUS hydrorefined distillate). Processes for obtaining such distillates and such hydrogenated oils are disclosed, for example, in the previously referred to applications and patents of Mills and co-inventors. Such oils are available under the trade name "Sunthene".

Although the base oil can have a viscosity at 100°F in the range of 60 to 600 SUS, the preferred viscosity range is 125 to 300 SUS and, more preferred, 140 to 220 SUS. When the viscosity of the base oil is less than about 125 SUS, the flash point becomes so low that it is difficult to heat the oil sufficiently to incorporate the lithium stearate. Generally the oil should be heated to about 400°F for proper lithium stearate incorporation.

A blended base stock can be advantageous in such additive incorporation since the lithium can be first incorporated in a hot, higher flash point component oil (e.g., 2,500 SUS) and the mixture cooled prior to incorporation of other additives and the lower flash point remainder of the base oil. This flash point problem was considerably less in making prior art textile lubricants with paraffinic base oils since the paraffinic oils have generally much higher flash points for a given viscosity at 100°F than do hydrogenated naphthenic oils.

For lubrication of looms, and most other textile machinery, the viscosity of the base oil at 100°F is preferably no greater than 300 SUS because a higher viscosity base oil can produce a textile lubricant which causes too great an increase in start-up torque of the machinery. However, a protective coating for metals (e.g., firearms) can be made from the same additives as the textile machinery lubricant and in which the base oil has a viscosity as high as 600 SUS at 100°F.

To improve such properties as color, flash point and oxidation stability, the base oil can also contain in the range of 0.5 to 15% of hydrorefined paraffinic oil, solvent-refined paraffinic oil, hydrocracked paraffinic oil (see Ser. No. 178,193), naphthenic distillate, naphthenic-acid free naphthenic distillate, polyolefin oils or hydrogenated polyolefin oils.

The base oils preferably contain less than 80 ppm of basic nitrogen, more preferably less than 30 ppm (in some cases 0 to 10 ppm), and can be those described in the previously cited applications of Mills et al. and, more preferably, are blends of two or more hydrorefined naphthenic oils (e.g., a 150 SUS blend of a 100 SUS at 100°F hydrorefined naphthenic oil and a 2,500 SUS at 100°F hydrorefined oil) or a blend of hydrorefined naphthenic oil and hydrocracked paraffinic oil.

In the lubricant of the present invention, the base oil can have an aniline point in the range of 140 to 180, preferably the aniline point of the base oil is in the range of 150° to 170°F to enable maintenance of good rubber seal condition. Preferably, the oil or blend of oils is selected so as to obtain a base with the desired viscosity, an ultraviolet absorptivity at 335 millimicrons (i.e., 335 UVA) in the range of 0.01 to 0.4, more preferred 0.02 to 0.2, and an aniline point in the range of 150° to 170°F. The hydrorefined naphthenic oil component of such a base stock will generally have an aniline point in the range of 140 to 190, more preferred 150° to 170°F.

Lubricants which are mostly paraffinic in structure have high aniline points and will shrink the rubber and make it hard. This permits the lubricant to leak. On the other hand, if the aniline point is below 150°F, excessive swell often occurs and the seal may be cut and torn by the rubbing surface, thereby allowing lubricant to bypass. Seal conditioning additives can also be used to improve seal performance in the lubricant.

The phrases "severe hydrorefining" or "hydrogenation" refer to processes conducted in the presence of a hydrogenation catalyst at from about 500° to 775°F, with hydrogen of 50 to 100% purity, and from 800 to 3,000 psi of hydrogen at the reactor inlet (at total pressures from 800 to 6000 psig) at a fresh feed liquid hourly space velocity (LHSV) of from 0.1 to 8.0 (usually below 2.0), preferably conducted either in vapor phase or trickle phase. Such hydrogenation or severe hydrorefining is to be distinguished from hydrocracking in that the production of "overhead" (i.e., hydrocarbons boiling below 485°F) is less than 25% by volume per pass through the reactor (and, typically, less than 10%). Product recycle, for example, as in U.S. Pat. No. 2,900,433, can be used to increase severity. Recycle liquid hourly space velocity can vary from 0 to 20; however, it is preferred to operate at total liquid throughputs that obtain at greater than 25% of flooding velocity and more preferably at from 40 to 98% of flooding velocity.

Preferably, the temperature is below that at which substantial cracking occurs, that is, no more than 20 weight percent (preferably less than 10%) of the feed stock is converted to material boiling below 300°F in a single pass through the reactor. Although the maximum hydrogenation temperature which will not produce substantial cracking is somewhat dependent upon the space velocity, the type of catalyst and the pressure, generally it is below 750°F but can be as high as 785°F. To allow a margin of safety, it is preferred to operate below 700°F (except when it is desired to obtain a hydrogenated oil containing more gel aromatics than are in the charge). At total pressures below about 2000 psi the preferred temperature is below about 660°F, since above that temperature the degradation of oil viscosity can become large.

Typical of such severe hydrorefining methods, when conducted within the aforementioned processing conditions, are those of U.S. Pat. Nos. 2,968,614; 3,993,855; 3,012,963; 3,114,701; 3,144,404;

3,278,420; 3,502,567; 3,619,414; 3,642,358 and 3,681,279 and those of the previously referred to copending application Ser. No. 730,999. The terms "severely hydrorefined oil" or "hydrogenated oil" include the products, within the lubricating oil boiling range, of such severe hydrorefining or hydrogenation. One characteristic of a severely hydrorefined or hydrogenated oil is that the ratio of monocyclic aromatics to polycyclic aromatics is significantly greater than in hydrotreated oils or conventional distillate oils.

Where the desired hydrorefined oil is to be of the naphthenic class, a preferred charge to the hydrogenation reactor can be obtained by vacuum distillation of naphthenic or "mildly aromatic" crude oils (as in U.S. Pat. No. 3,184,396), especially those crude oils wherein the 1,500 to 3,000 SUS (at 100°F) distillate fractions have viscosity-gravity constants from 0.84 to 0.92. Preferably, such a charge stock should be substantially free of naphthenic acids prior to the hydrorefining (thus, in some cases distillation in the presence of caustic is advantageous). Usually materials boiling below about 600°F (including residual $H_2S$, $NH_3$, etc.) are removed from the hydrorefined oils, as by atmospheric distillation (and the viscosity can also be adjusted by choice of distillation end point) prior to clay contacting (if the oils are to be clay finished). Such naphthenic distillate oils are available commercially under the trade name "Circosol".

The viscosity of the base oil, or of the final hydrorefined oil, can be adjusted by the addition of other oils of higher or lower viscosity and which are within the lube oil boiling range. Where desired, the basic nitrogen content can be lowered by contacting the charge or hydrogenated oil or the blend of hydrogenated oils with sufficient acidic adsorbent or mineral acid to reduce the basic nitrogen content of the oil, as to below 10 ppm.

By naphthenic distillate, we refer to a distillate fraction (or a mildly acid-treated distillate fraction, or a solvent raffinate fraction or an acid-treated raffinate) usually from vacuum distillation, of a crude which is classified as naphthenic (including "relatively naphthenic") by the viscosity-gravity constant (VGC) classification method (see pp. 79-80 Plasticizer Technology, Vol. 1, p. 5 Bruins, Reinhold Publishing Corp. New York, 1965). Preferably, such crudes are "Grade A" (wax-free), typically Gulf Coastal, and include, for example, Refugio, Mirando, and Black Bayou. The lower VGC oils can be obtained from mid-continental crudes; and can be dewaxed if desired (as by extraction or isomerization). Such naphthenic fractions will have a VGC in the range of 0.820 to 0.899 and typically, a viscosity in the range of 150 to 12,000 SUS at 100°F (for example, 500 to 6,000). In some cases the crude (and distillate) can have a VGC as high as 0.94 (such crudes are characterized as "mildly aromatic"), or higher (e.g., 0.96+). Deep furfural extraction (e.g., about 50% yield) of a high VGC Grade A crude can be used to produce a wax-free, lower VGC fraction (e.g., 0.83 VGC).

Typically, paraffinic oils are those having a viscosity-gravity constant (VGC) in the range of 0.790 to 0.819 (preferably above 0.799). Typical of solvent refined paraffinic lubes are those available commercially under the trade name "Sunpar". Typical hydrorefined paraffinic lubes are those available commercially under the trade name Sunpar, H series (e.g., "Sunpar 110 H").

Naphthenic oils have a VGC in the range of 0.820 to 0.899 and the preferred hydrorefined naphthenic oils have a VGC in the range of 0.850 to 0.899. Hydrorefined, relatively aromatic oils, having a VGC in the range of 0.900 to 0.920, can sometimes be used as a whole or partial substitute for the hydrorefined naphthenic lube. Aromatic oils (including hydrorefined or hydroaromatized oils) having a VGC in the range of 0.921 to 1.050 and greater, can be useful in minor proportions (e.g., 1 to 20%) for adjusting the aniline point of the base oil, particularly when the base oil contains a high proportion (e.g., 20%) of a high VI hydrocracked paraffinic oil.

As an additional component to the hydroefined naphthenic oils previously described, the lubricant can contain a hydrogenated polyolefin oil (e.g., see Serial No. 220,362 of Stearns et al; Canadian Pat. No. 842,290; and U.S. Pat. Nos. 3,598,740 and 3.778,487) or a hydrocracked oil (e.g., see Ser. No. 178,193) or a mixture of such components (e.g., see Ser. No. 298,126). Such oils can be dewaxed, if desired. In such blends an aromatic oil or concentrate rich in aromatic hydrocarbons (e.g., cycle oil) may have to be added to obtain the proper aniline point for seal swelling.

A synthetic ester component (e.g., an azelate diester as in Ser. No. 279,160) can be useful in some cases.

The preferred polyolefin oils are polymers or copolymers of $C_2$–$C_8$ olefin which have a pour point no greater than −35°F, and preferably below −50°F. The hydrogenation can be from 50 to 100% of saturation, and preferably is to a bromine number no greater than 10, more preferably less than 5. Preferred polyolefins include ethylene-propylene copolymer, polypropylene, polybutene (especially polyisobutylene), and poly(1-octene).

The high VI hydrocracked paraffinic oil component can be obtained by hydrocracking a high viscosity distillate or dewaxed distillate from a paraffinic crude (such as Lagomedio) and typically has a VI in the range of 90 to 105 and contains in the range of 3 to 30% of aromatics by clay-gel analysis. The hydrocracked lubes are preferably stabilized (against UV light degradation and sludging) by extraction of the hydrocracked oil with aromatic selective solvents, such as furfural or phenol or by hydrorefining to reduce the 260 UVA at least 30% (preferably 40%). For examples of such oils see Ser. No. 178,193 of Bryer et al. and U.S. Pat. No. 3,579,435 to Olenzak et al.

The preferred "stabilized" hydrocracked oils (whether extracted or hydrorefined) are characterized by having a D-943 test life (to an increase in acid number of 2.0) which is at least 20% lower than the D-943 life of an unstabilized hydrocracked oil but which is at least 20% greater than the D-943 life (with the usual amount of inhibitor, e.g., 0.5% DBPC) of an unhydrocracked solvent refined paraffinic lube of the same viscosity.

The preferred soap is lithium stearate; however, any of the prior art lithium soaps which have been used in petroleum lubricants can be useful in textile oils of the present invention. Such soaps are shown, for example, in U.S. Pat. Nos. 2,489,300 and 3,383,312. For soap thickening, the preferred lithium soaps include soaps of fatty acids containing in the range of 12 to 22 carbon atoms, preferably an unsubstituted fatty acid. Stearates, palmitates, tallates, laurates, oleates and mixed soaps are among the useful soaps.

ILLUSTRATIVE EXAMPLES

In the following examples, as elsewhere in this application, UVA stands for ultraviolet absorptivity, all percentages are by weight and all viscosities are at 100°F, unless otherwise noted.

EXAMPLE 1

A high retention, textile machinery lubricant was compounded using a base oil comprising hydrogenated naphthenic oil, and containing high molecular weight polyisobutylene (as a tackiness agent) and lithium stearate.

The textile machinery lubricant composition had a MacMichael viscosity of about 25 at 70°F and contained a 150 SUS (at 100°F) base oil having an aniline point of 162 and consisting of 19.30 parts of 2,400 SUS (at 100°F) hydrorefined naphthenic oil containing 45% aromatics and having a 260 UVA of 5.7, a 335 UVA of 0.22 and 76.38 parts of 100 SUS (at 100°F) hydrorefined naphthenic oil containing 35% aromatics and having a 260 UVA of 2.3 and a 335 UVA of 0.03. Both hydrorefined naphthenic oils were obtained from naphthenic acid-free, naphthenic distillate by hydrogenation at 625°F, 1200 psig of 80% hydrogen, 0.2 LHSV with a presulfided nickel-molybdenum oxide catalyst. Before hydrorefining the 100 SUS distillate had a 260 UVA of 7.3, a 335 UVA of 0.23 and contained 44% aromatics; whereas, the 2,500 SUS distillate had a 260 UVA of 10.5, and 335 UVA of 0.68 and contained 47% aromatics.

In addition to the base oil, the textile-machinery oil contained 1.9 parts of commercial polyisobutylene (available under the trade name "Paratac-N" of Enjay Company), 0.7 parts lithium stearate, 0.4 parts of DBPC antioxidant, 0.02 parts of a defoamer containing 1% active ingredients (Dow Corning Silicone), and 1.3 parts of chlorinated paraffin (Chlorafin 40), containing 40% chlorine. The chlorinated paraffin imparts especially useful antiwear properties and does not discolor or damage textiles. The degree of chlorinatiion of this additive can vary considerably, depending on the manufacturer and grade; however, all such presently commercially available light colored, chlorinated paraffins can be used in the lubricant of the present invention.

The Compounding Procedure follows:

1. Mix all of the lithium-stearate with all of the 2,500 SUS oil and heat to 400° to 410°F for ten minutes with mechanical agitation.
2. Stop heat and add 100 SUS oil; cool as quickly as possible, to about 150°F.

Add remaining additives at 140° to 150°F.

4. Continue agitation until blend cools to 130°F.

EXAMPLE 2

A textile-machinery lubricant was compounded using the same additives and procedures as that of Example 1, except that the base oil was a 150 SUS solvent refined paraffinic lube (sold as "Sunpar 115") having a VGC of 0.803, viscosity at 210°F of about 43.6 SUS and an aniline point of 221. The paraffinic lube was made by blending two commercially available solvent refined paraffinic distillates, "Sunpar 110" (75.55 parts) and "Sunpar 120" (20.00 parts).

EXAMPLE 3

The storage stability of this paraffinic base lubricant of Example 2 was compared with that of the Example 1 lubricant by a centrifuging stability test method. The stability test was run by centrifuging each oil at 2,500 rpm for six hours. The lubricant of Example 2 showed a significant amount of separation. The Example 1 oil, on the other hand, showed no hint of separation (i.e., no visible separation). A commercially available textile machine oil (Mobilplex EP-23) was also tested by such centrifuging and, like the Example 2 oil, separation was observed.

EXAMPLE 4

Another lab evaluation was conducted in a complete "Alemite" lubrication system. In this study the lubricator was pulsed on three-minute cycles or about 16 times faster than normal in plant operation. Each lubricant was run for 700 hours, which would be equivalent to about 11,000 hours in the field. Moreover, during the test, the lubricator stand was constantly vibrated by a small eccentric electric motor to promote the separation and/or stratification of the oils.

The results confirmed those from the centrifuge test of Example 3. The oil of Example 1 showed no tendency to separate or stratify under these conditions. In addition, the critical system components, including the filter and injectors, gave no evidence of plugging.

A commercially available textile-machinery lubricant (of the paraffinic type) stratified considerably when so tested in an Alemite system.

The results of both these tests showed that the Example 1 oil had significantly improved stability.

EXAMPLE 5

The Example 1 oil also had other required textile-machine oil properties. The Example 1 oil was subjected to a special test to measure the retention or anti-leak characteristics of machine oils. The test correlates with field performance, and for this reason was used to compare the Example 1 oil with the Example 2 oil and with a conventional machine oil which contained no additives to improve oil retention.

The special test apparatus was a combination of ¾-inch iron nipples, union sleeves, and elbows. They were joined together "hand tight" in a U-shape and spot-welded to hold a fixed position. In the test 300 ml of oil were poured into the apparatus and it was then pressurized to 30 psi with nitrogen and allowed to stand at the selected test temperature for one hour. The oil that leaked from the apparatus was collected and weighed.

There was no significant difference in leakage between the Example 1 and Example 2 oil, both giving about 10 times less leakage than the conventional oil.

However, the Example 1 oil has a leak-reducing feature not found in the Example 2 oil. The Example 1 oil keeps rubber seals soft and pliable and causes them to swell slightly, thus eliminating a field usage problem of seal shrinkage. The difference between the Example 1 and Example 2 oils is demonstrated by the following lab data:

| | Example 1 Oil | Example 2 Oil |
|---|---|---|
| Rubber Swell Test, & 212°F, 168 Hours | +8.2 | −0.1 |

Buna N seals swell in the Example 1 oil and thus keep snug tolerances and prevent leakage which takes place in usage due to wear.

Thus, the Example 1 lubricant has a combination of good retention properties plus the seal-conditioning feature which results in less stray oil in textile plants than with the Example 2 lubricant.

EXAMPLE 6

Even with the excellent retention properties of the Example 1 lubricant, in field usage it will occasionally come into contact with cloth. It is important therefore, that the oil not weaken the fabric after the finishing steps are completed.

The damaging potential of textile machine oils can be evaluated by the method of the Institute of Textile Technology (ITT). In the evaluation, the test oil is run for 8 hours in a laboratory-mounted bearing to simulate used lubricant conditions. During this period, the bearing temperature is recorded (it was essentially the same for the lubricant of Example 1 and the lubricant of Example 2, running between 105° and 110°F).

When the sample preparation is complete, the oil is applied to desized cotton test fabric. Before bleaching, one half of the contaminated fabric samples, as well as control pieces, are treated with 1% sulfuric acid solution for 30 minutes. The test pieces are then boiled one hour in 2% caustic, rinsed with tap water, bleached with a hydrogen peroxide solution for one hour, rinsed and dried. The samples and controls are then subjected to a break-strength test to determine the deterioration caused by the oil.

The data for the lubricants of Example 1 and Example 2 are compared in the following table:

| | Example 1 | Example 2 |
|---|---|---|
| Fabric Break Strength % of Control Sample | | |
| With acid treatment | 97.6 | 94.8 |
| Without acid treatment | 87.8 | 89.1 |

These data show that both are excellent in terms of cloth scourability with minimum fiber damage.

The Example 1 oil also produced less staining of cloth. These test results caused the Example 1 oil to obtain the highest possible ITT rating and make it applicable in all textile plants.

EXAMPLE 7

The oil of Example 1 was field tested by several major textile manufacturers. The primary testing was done at one large North Carolina mill in Draper shuttleless looms, which are lubricated every 48 minutes by a "Lincoln" automatic system. The Example 2 oil was used as the standard, and three commercially applicable lubricants were also tested. The oils were all checked for gear temperatures and, most importantly, for power costs which are calculated from amperage readings.

The results, relative to the Example 2 oil, were as follows:

| Description Loom Test | Commercial Lubricants B | C | D | Example 1 Lubricant* |
|---|---|---|---|---|
| Gear Temp, °F** | | | | |
| Motor Side | +17 | +44 | +30 | +17 |
| Other Side | +12 | +45 | +36 | +17 |
| Power Costs,%** | +4.8 | +5.5 | +7.9 | −5.7 |
| Overall Performance | Satisfactory | Unsatisfactory | Unsatisfactory | Satisfactory |

*Average of 2 tests
**Data relative to Example 2 oil

The Example 1 lubricant was the only oil which provided power savings. The temperature differences were not considered significant. Oil B was Gulf Harmony 121, Oil C was Texaco Rock Drill 1,543 and Oil D was Humble Nuto 113.

In a test at another southern mill, the lubricating properties of the Example 1 lube were found to equal those of the Example 2 oil, but the Example 1 oil had better staining and removal properties. No separation problems were noted.

The examples above show that the Example 1 lubricant not only solves the separation problem noted occasionally in the field with prior art oils, but it also has lighter color and brighter appearance and causes less staining should it come in contact with fabric during manufacture.

In addition to the stability and appearance, the Example 1 lubricant conditions and protects rubber seals and provides lower mill power consumption and cost. The Example 1 oil is also useful as a military automotive and artillery grease. The preferred range (150° to 170°F) of aniline point for the base oil disclosed herein is not necessarily the preferred range if non-hydrocarbon seal swelling agents are contained in the lubricant. For other rubbers than Buna N, Neoprene, etc., such as the silicones, a different aniline point range may be required for proper swelling (e.g., for silicone rubbers and an aniline point in the range of 195° to 215°F is preferred).

The following Table I lists the properties of the textile-machinery lubricant of Example 1, which is a lubricant of the present invention. The table also lists a preferred range for these properties; however, the lubricant of the present invention need not have properties within this range.

Tables II and III list typical properties of commercially available naphthenic lubes (before and after hydrorefining) which can be used in practice of the present invention. The distillate oils are sold under the trade name "Circosol" and the hydrorefined oils are sold under the trade name "Sunthene".

TABLE I

| | Method* | Example 1 | Preferred Range of Properties |
|---|---|---|---|
| Viscosity MacMichael/70°F | | 25 | 20–35 |
| Flash, COC, °F | D-92 | 280 | 270 min |
| Fire, COC, °F | D-92 | 330 | 310 min |
| Pour, °F | D-97 | −20 | — |
| Color | D-1500 | 2.5 | 3.5 max |
| Appearance | Visual | Slight haze | — |
| Gravity, °API | D-287** | 26.5 | 25.5–27.5 |
| Pounds per Gallon | D-1250** | 7.46 | — |
| Specific Gravity | D-1250** | 0.896 | 0.890–0.901 |
| pH | | 9.0 | — |
| Cu Strip Class 212°F, 3 hr | D-130 | 1 | 1 max |
| Sulfur, % | D-129 | 0.08 | — |
| Conradson, C % | D-189 | 0.22 | — |
| Aniline Point, °F | D-611 | 162 | — |

TABLE I-continued

| | Method* | Example 1 | Preferred Range of Properties |
|---|---|---|---|
| Ash, % | D-482 | 0.04 | — |
| Sulfated Ash | D-874 | 0.11 | |
| Foam, Tendency | | | |
| Stability | D-892 | | |
| Sequence I, ml | | 0/0–10/0 | 50/0 max |
| Sequence II, ml | | 50/15–25/0 | 50/0 max |
| Sequence III, ml | | TR/TR–1–/0 | 50/0 max |
| Rusting, distilled water | D-665 | pass | pass |
| 4-Ball Wear Scar 25 Kg, 1800 rpm, 167°F, 1 hr. | | 0.45 | — |
| Lithium, ppm | 17160–200 | | |

TABLE I-continued

| | Method* | Example 1 | Preferred Range of Properties |
|---|---|---|---|
| Chlorine, % | D-808 | 0.55 | 0.49–0.64 |

*ASTM test method numbers.
**Calculated from data obtained by picnometer. Accurate results cannot be obtained using a hydromener.

TABLE II

TYPICAL DATA OF COMMERCIALLY AVAILABLE HYDROREFINED NAPHTHENIC LUBES

| Property | ASTM Test | Oil 1 | Oil 2 | Oil 3 | Oil 4 | Oil 5 | Oil 6 | Oil 7 | Oil 8 |
|---|---|---|---|---|---|---|---|---|---|
| Viscosity, SUS at 100°F | D-2161-66 | 104 | 155 | 210 | 502 | 780 | 1275 | 2206 | 5047 |
| Viscosity, SUS at 210°F | D-2161-66 | 38.0 | 41.0 | 43.1 | 52.0 | 59.0 | 67.7 | 84.7 | 126.5 |
| API Gravity at 60°F | D- 287-67 | 24.2 | 23.3 | 22.5 | 20.6 | 19.9 | 19.3 | 18.6 | 19.0 |
| Specific Gravity at 60°F | D-1250-56 | .9088 | .9140 | .9190 | .9303 | .9350 | .9380 | .9427 | .9402 |
| Flash Point, COC, °F | D- 92-66 | 330 | 335 | 345 | 385 | 365 | 400 | 440 | 470 |
| Volatility, 22 Hours at 225°F (Wt.%) | D- 972-56 | 6.38 | 5.25 | 4.57 | 2.53 | 1.81 | 1.00 | 0.23 | 0.02 |
| Pour Point, °F | D- 97-66 | −50 | −30 | −25 | −10 | −5 | 0 | +15 | +20 |
| Color, ASTM D-1500 | D-1500-64 | 0.5 | 0.5 | 0.5 | 1.0 | 1.0 | 1.0 | 1.5 | 1.5 |
| UV Absorptivity at 260 mu | D-2008-68 | 2.2 | 3.0 | 3.4 | 4.1 | 4.8 | 5.3 | 5.7 | 6.7 |
| Molecular Weight | D-2502 | 205 | 325 | 330 | 355 | 370 | 380 | 400 | 450 |
| Viscosity-Gravity Constant | D-2501-67 | .871 | .873 | .875 | .878 | .881 | .881 | .882 | .871 |
| Refractive Index, 20/D | D-1747-62 | 1.4986 | 1.5015 | 1.5039 | 1.5104 | 1.5130 | 1.5146 | 1.5170 | 1.5174 |
| Refractive Intercept | D-2159-64 | 1.0460 | 1.0463 | 1.0463 | 1.0471 | 1.0473 | 1.0474 | 1.0475 | 1.0491 |
| Carbon Type Analysis | D-2140-62 | | | | | | | | |
| Aromatic C Atoms, Ca % | — | 15 | 16 | 16 | 15 | 17 | 18 | 18 | 18 |
| Naphthenic C Atoms, Cn % | — | 42 | 42 | 42 | 43 | 41 | 41 | 41 | 36 |
| Paraffinic C Atoms, Cp % | — | 43 | 42 | 42 | 42 | 41 | 41 | 41 | 46 |
| Molecular Type Analysis (Clay Gel) | D-2007-70 | | | | | | | | |
| Asphaltenes, Wt.% | — | 0 | 0 | 0 | 0 | 0 | 0 | 0 | 0 |
| Polar Compounds, Wt.% | — | 0.2 | 0.4 | 0.5 | 0.7 | 0.8 | 1.0 | 1.1 | 2.0 |
| Aromatics, Wt.% | — | 34.8 | 37.6 | 38.5 | 42.3 | 43.2 | 43.0 | 43.9 | 41.8 |
| Total Aromatics, Wt.% | — | 35.0 | 38.0 | 39.0 | 43.0 | 44.0 | 44.0 | 46.0 | 43.8 |
| Saturates, Wt. % | — | 65.0 | 62.0 | 61.0 | 57.0 | 56.0 | 56.0 | 55.0 | 56.2 |
| Aniline Point, °F | D- 611-64 | 156 | 160 | 162 | 164 | 171 | 174.0 | 176.0 | 193 |
| ASTM Type | D-2226-69 | 103 | 103 | 103 | 103 | 103 | 103 | 103 | 103 |

Oils 2, 3, 5 and 6 are blends of Oils 1 and 7

TABLE III

TYPICAL DATA OF COMMERCIALLY AVAILABLE NAPHTHENIC DISTILLATE OILS

| Property | ASTM Desig. | Oil A | ASTM Oil No. 3 | Oil B | Oil C | Oil C | Oil E | Oil F | Oil G | Oil H |
|---|---|---|---|---|---|---|---|---|---|---|
| Viscosity, SUS at 100°F | D-2161-66 | 108 | 156 | 208 | 310 | 515 | 780 | 1276 | 2525 | 5945 |
| Viscosity, SUS at 210°F | D-2161-66 | 38.2 | 41 | 43.2 | 46.8 | 52.4 | 58.8 | 68 | 87.2 | 135 |
| API Gravity at 60°F | D- 287-67 | 22.2 | 22.4 | 21.0 | 20.1 | 19.6 | 19.1 | 18.4 | 17.6 | 17.3 |
| Specific Gravity at 60°F | D-1250-56 | .9206 | .9194 | .9279 | .9334 | .9365 | .9396 | .9440 | .9490 | .9509 |
| Flash Point, COC, °F | D- 92-66 | 320 | 330 | 345 | 355 | 380 | 390 | 405 | 430 | 495 |
| Volatility, 22 Hours at 225°F (Wt.%) | D- 972-56 | 7.58 | 5.96 | 5.40 | 4.35 | 3.08 | 2.11 | 1.67 | 0.16 | 0.02 |
| Pour Point, °F | D- 97-66 | −45 | −35 | −30 | −15 | −10 | −5 | 0 | +10 | +20 |
| Color, ASTM D-1500 | D-1500-64 | 1.25 | 1.75 | 1.75 | 2.0 | 2.0 | 2.5 | 3.0 | 3.5 | 5.75 |
| Molecular Weight | D-2502 | 295 | 325 | 325 | 345 | 355 | 370 | 380 | 395 | 450 |
| Viscosity-Gravity Constant | D-2501-67 | 0.884 | 0.878 | 0.884 | 0.887 | 0.885 | 0.885 | 0.885 | 0.889 | 0.884 |
| Refractive Index, 20/D | D-1747-62 | 1.5081 | 1.5079 | 1.5121 | 1.5160 | 1.5167 | 1.5190 | 1.5210 | 1.5222 | 1.5250 |
| Refractivity Intercept | D-2159-64 | 1.0502 | 1.0479 | 1.0500 | 1.0511 | 1.0503 | 1.0510 | 1.0508 | 1.0495 | 1.0495 |
| Carbon Type Analysis | D-2140-62 | | | | | | | | | |
| Aromatic C Atoms, Ca % | — | 21 | 20 | 21 | 22 | 21 | 22 | 22 | 21 | 20 |
| Naphthenic C Atoms, Cn % | — | 37 | 36 | 37 | 36 | 37 | 36 | 36 | 39 | 38 |
| Paraffinic C Atoms, Cp % | — | 42 | 44 | 42 | 42 | 42 | 42 | 46 | 40 | 42 |
| Molecular Type Analysis (Clay Gel) | D-2007-70 | | | | | | | | | |
| Asphaltenes, Wt.% | — | 0 | 0 | 0 | 0 | 0 | 0 | 0 | 0 | 0 |
| Polar Compounds, Wt.% | — | 1.1 | 1.2 | 1.8 | 2.0 | 2.5 | 2.7 | 3.0 | 2.7 | 4.2 |
| Aromatics, Wt.% | — | 43.0 | 41.7 | 44.0 | 44.0 | 43.8 | 43.6 | 44.0 | 44.8 | 44.7 |
| Total Aromatics, Wt.% | — | 44.1 | 42.9 | 45.8 | 46.0 | 46.3 | 46.3 | 47.0 | 47.5 | 48.9 |
| Saturates, Wt. % | — | 55.9 | 57.1 | 54.2 | 54.0 | 53.7 | 53.7 | 53.0 | 52.5 | 51.1 |
| Aniline Point, °F | D- 611-64 | 145 | 156 | 152 | 154 | 156 | 162 | 166 | 172 | 183 |
| ASTM Type | D-2226-69 | 103 | 103 | 103 | 103 | 103 | 103 | 103 | 103 | 103 |

Oils B, C, E and F are blends of oils A and C

The invention claimed is:

1. A high retention lubricant for textile-machinery, said lubricant comprising a base oil, an effective amount of a tackiness agent for retention in a bearing, and sufficient lithium soap to provide a MacMichael viscosity at 70°F in the range of 5 to 15, said base oil having a viscosity in the range of 60 to 600 SUS at 100°F, a 335 UVA in the range of 0.01 to 0.4, and an aniline point in the range of 150° to 170°F, and containing in the range of 85 to 100% of at least one hydrorefined naphthenic oil component having a viscosity in the range of 40 to 12,000 SUS at 100°F, said tackiness agent being selected from the group consisting of polyacrylates, aluminum oleate, olefin polymer, hydrogenated olefin polymer, mixtures of hydrogenated and unhydrogenated olefin polymer, and natural rubber obtained from dehydrated latex.

2. A lubricant according to claim 1 wherein said base oil contains a wide boiling range blend of at least two hydrorefined naphthenic oils.

3. A lubricant according to claim 1 wherein said tackiness agent is polyisobutylene or hydrogenated polyisobutylene or a mixture of polyisobutylene and hydrogenated polyisobutylene.

4. A lubricant according to claim 1 and containing 0.3 to 10% of a chlorinated paraffin or 0.2 to 2% of tricresyl phosphate, as an antiwear agent.

5. A lubricant according to claim 4 and containing 0.05 to 20 ppm of a silicone antifoam.

6. A lubricant according to claim 5 and containing 0.05 to 1% of ditertiarybutyl paracresol as an antioxidant.

7. A lubricant according to claim 1 wherein said base oil contains in the range of 0.1 to 15% of hydrorefined paraffinic oil, solvent-refined paraffinic oil, naphthenic distillate or naphthenic acid-free naphthenic distillate.

8. A lubricant according to claim 1 where the aniline point of said hydrorefined naphthenic oil component is in the range of 150° to 170°F.

9. Hydraulic oil according to claim 1 wherein said lithium soap is a soap of a $C_{12}$–$C_{22}$ fatty acid.

10. In the art of lubrication of textile machinery, the improvement which comprises lubricatiing said machinery with the lubricant of claim 1.

* * * * *